US005322493A

United States Patent [19]

Venner

[11] Patent Number: 5,322,493

[45] Date of Patent: Jun. 21, 1994

[54] LEG MUSCLE CONDITIONING DEVICE

[76] Inventor: Frederic S. F. Venner, 14 Center St., Barre, Vt. 05641

[21] Appl. No.: 15,135

[22] Filed: Feb. 9, 1993

[51] Int. Cl.[5] ..... A63B 21/00

[52] U.S. Cl. ..... 482/131; 482/114; 482/133; 482/148; 482/907

[58] Field of Search ..... 482/70, 79, 124, 131, 482/133, 148, 907, 114, 51, 139, 906; 273/188 A, 188 R, DIG. 5; 2/319, 338

[56] References Cited

U.S. PATENT DOCUMENTS

| | | | |
|---|---|---|---|
| 1,998,226 | 4/1935 | Draheim . | |
| 2,224,103 | 12/1940 | Nilson . | |
| 2,998,008 | 8/1961 | Klesa | 2/338 |
| 3,350,096 | 10/1967 | Kile et al. | 273/188 R |
| 3,749,400 | 7/1973 | Stoffel | 273/DIG. 5 |
| 3,966,204 | 6/1976 | Dubach . | |
| 4,132,404 | 1/1979 | Wilson . | |
| 4,277,062 | 7/1981 | Lawrence . | |
| 4,445,684 | 5/1984 | Ruff . | |
| 4,506,884 | 3/1985 | Hankin . | |
| 4,659,077 | 4/1987 | Stropkay | 482/70 |
| 4,781,373 | 11/1988 | Irwin . | |
| 4,844,453 | 7/1989 | Hestilow . | |
| 4,877,239 | 10/1989 | Dela Rosa . | |
| 4,889,336 | 12/1989 | Schneiderman . | |
| 4,988,096 | 1/1991 | Jones . | |
| 5,004,228 | 4/1991 | Powers . | |
| 5,147,266 | 9/1992 | Bicard | 482/131 |

FOREIGN PATENT DOCUMENTS

| | | | |
|---|---|---|---|
| 2001557 | 7/1971 | Fed. Rep. of Germany | 482/79 |
| 2160433 | 12/1985 | United Kingdom | 482/148 |
| 2223955 | 4/1990 | United Kingdom | 482/907 |

OTHER PUBLICATIONS

"Flexerciser" advertisement made by Saitama Kako Co., Ltd. dated Nov. 1983.

*Primary Examiner*—Richard J. Apley
*Assistant Examiner*—Jeanne M. Mollo
*Attorney, Agent, or Firm*—Nies, Kurz, Bergert & Tamburro

[57] ABSTRACT

A leg muscle stretching and conditioning device in the form of a belt made from flexible material, and a pad member having a slot through which the belt is passed. The pad member is slidable along the belt and preferably includes a plurality of alternating ridges and grooves along its lower surface to permit the pad member to be slidable over a wide variety of surfaces. In use, the user applies one foot on the belt to hold the belt in position and to prevent movement of the belt in a direction along the belt longitudinal axis. The other foot of the user is placed on the pad member so that the user's heel is received within a recess formed on the top surface of the pad member. This foot is moved to convey the pad member along the belt and support surface employing the frictional force between the pad member lower surface and the surface over which the pad member is moved to insure stability during performance and to guarantee gains achieved. The belt and pad member are substantially flat, for use on a flat surface, so that a user executing a split maneuver has his body fully supported by the surface on which the invention is supported.

10 Claims, 7 Drawing Sheets

LEG MUSCLE CONDITIONING DEVICE

BACKGROUND OF THE INVENTION

1. Field of the Invention

The present invention relates to a device for exercising and conditioning the leg muscles by permitting the user of the device to stretch the leg muscles in a controlled manner to enable the individual to more skillfully and to more effectively practice the martial arts. More particularly, the present invention relates to an easy-to-manufacture leg muscle stretching device suitable for martial arts students, dancers, and athletes, and that is of simple construction, inexpensive, portable, and convenient to use in a number of locations.

2. Description of the Related Art

Devices for exercising the leg muscles have been known for some time. For example, U.S. Pat. Nos. 1,998,226; 2,224,103; 3,966,204; and 4,889,336 each disclose elastic-type bands or cords of different shapes and forms for performing various types of leg muscle, arm muscle, and body muscle exercises. Similarly, U.S. Pat. Nos. 4,277,062; 4,877,239; 4,988,096; and 5,004,228 each show non-elastic leg muscle exercise devices, either using weights against which the leg muscles operate, or by pitting arm and leg muscles against each other by a combined leg and arm arrangement.

In addition to the above-identified patents U.S. Pat. No. 4,132,404, which issued on Jun. 2, 1979, to Raymond L. Wilson, shows a leg muscle stretching exercise device in which a pair of platforms having casters are connected by a rope. The user places his feet on respective ones of the linearly and pivotally movable platforms, which are elevated above the ground and are movable toward and away from each other by the user flexing his leg muscles to move his feet together and apart while they are on the platforms. The rope extends between the platforms and defines the maximum spacing between them to limit the extent of leg movement. However, because of the elevation of the platforms above the ground surface, the device lacks complete support for the body of a user when executing a "Chinese split" or a "dancer's split."

Another patent that discloses leg muscle stretching apparatus is U.S. Pat. No. 4,506,884, which issued on Mar. 26, 1985, to Stuart M. Hankin. That patent discloses a bulky structure including a two-piece base member having opposed, U-shaped support handles, and a pair of carts that are movable toward and away form each other along the base member.

Although the previously-known devices are generally satisfactory, the band-type devices are not especially effective for the leg muscle conditioning movements particularly desired by martial arts and dance students. The two devices disclosed in the Wilson and Hankin patents identified above are cumbersome to use, they are bulky and inconvenient to transport from place to place, and they are expensive to produce.

It is an object of the present invention to overcome the shortcomings of the known devices.

SUMMARY OF THE INVENTION

Briefly stated, in accordance with one aspect of the present invention, a leg muscle stretching and conditioning device is provided and is adapted for convenient portability and for use on a wide variety of surfaces. A pad member on which a user's foot is placed is provided. The pad member has an upper surface for receiving and supporting the foot of a user, a lower surface spaced from the upper surface for sliding engagement with a supporting surface, and a slot extending through the pad member between the upper and lower surfaces, the slot having a longitudinal axis.

A flexible belt member having a predetermined length is also provided. The belt member has a uniform transverse cross section conforming substantially in size and shape with the slot to permit the belt member to be slidably received in the slot for sliding movement of the pad member along a support surface and along and relative to the belt member, while the lower surface of the pad member and of the belt member are in contact with the supporting surface.

DESCRIPTION OF THE PREFERRED EMBODIMENTS

A canon of martial arts stresses the building of resolve within the character of the practitioner by training in as many different environments as may be found, and in all weather conditions, involving as many elements as feasible. It is toward successfully achieving and facilitating that dedication of perseverance that the leg stretching device in accordance with the present invention is directed, by virtue of its simplicity, adaptability, and virtually indestructible design.

Figure 2:
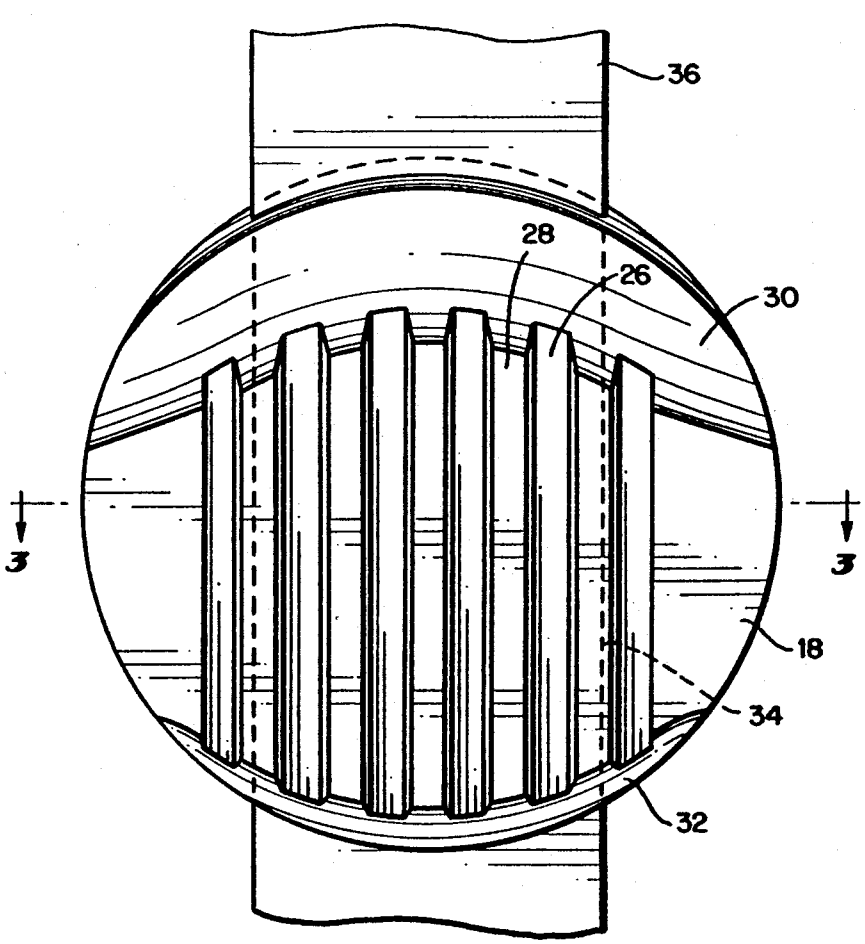
FIG. 2 is a fragmentary, bottom plan view of the device shown in FIG. 1.
Figure 1:
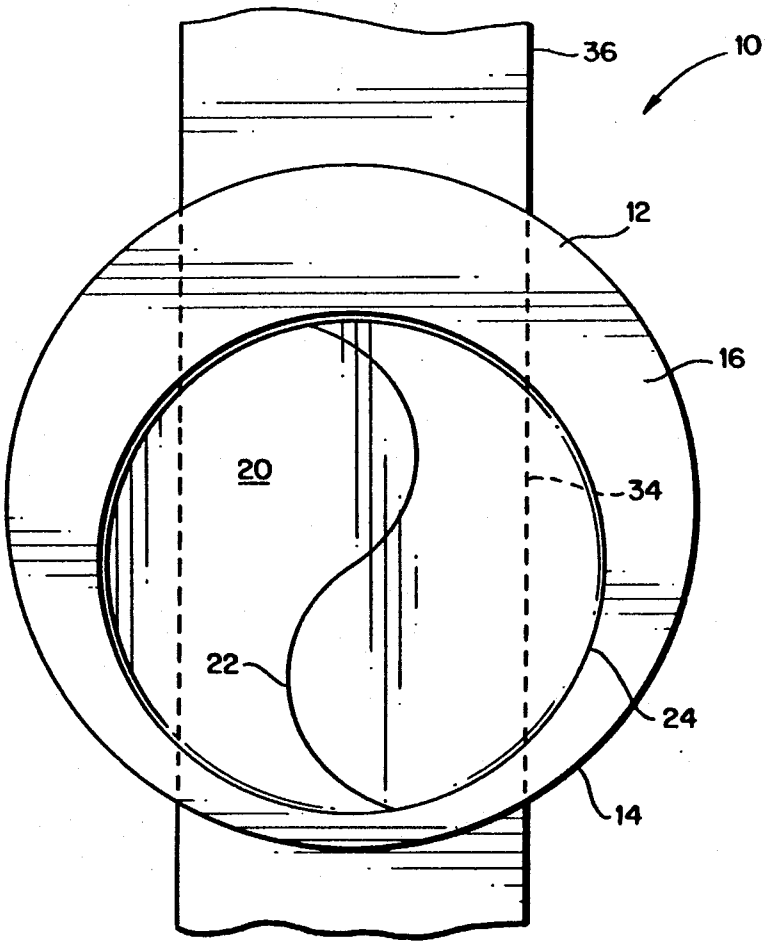
FIG. 1 is a fragmentary, top plan view of a leg muscle stretching and conditioning device in accordance with the present invention and including a pad member and a belt member.
Figure 3:
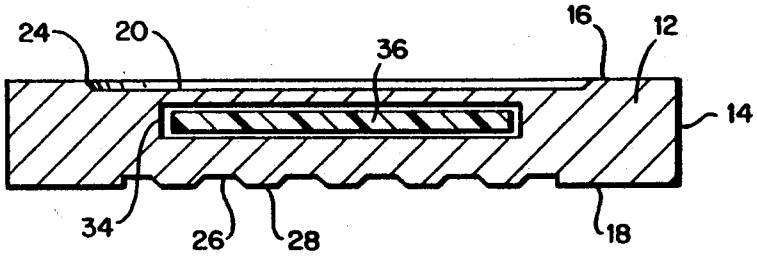
FIG. 3 is a transverse, cross-sectional view of the device as illustrated in FIG. 2, taken along the line 3—3 thereof.

Referring now to the drawings, and particularly to FIGS. 1, 2, and 3, there is shown a leg muscle stretching and conditioning device 10 in accordance with the present invention. The device includes a pad member 12 that can be in the form of a circular disk, as shown, or it can be of oval or any other convenient shape. A circular disk is preferred because it includes a smoothly curved outer periphery 14. Pad member 12 also includes a substantially planar upper surface 16 and a substantially planar lower surface 18, and can be made from wood, rigid molded plastic, or the like.

Upper surface 16 includes a recessed area 20 to receive the heel portion of the foot, as will hereinafter be explained. Preferably recessed area 20 is of circular conformation, as shown, but it can also be of another shape, if desired, to permit convenient and comfortable placement of the user's heel. Preferably, recessed area 20 has a center that is offset from the center of upper surface 16. As also shown in FIG. 1, recessed area 20 can include a representation of the oriental Yin-Yang symbol, defined by S-shaped demarcation line 22 positioned within a circular border 24, the Yin-Yang symbol serving as inspiration for the user by exhibiting the symbols representative of Yin, the feminine passive principle in nature, and of Yang, the masculine active principle in nature, which together combine to signify all that comes to be.

Referring now to FIGS. 2 and 3, the lower surface 18 of pad member 12 includes a plurality of alternating, parallel grooves 26, which define a plurality of alternating, parallel ridges 28 that lie between respective grooves. As shown, each of grooves 26 and ridges 28 is preferably of trapezoidal cross section, although the respective cross sections of the grooves and ridges can instead be rectangular, if desired. Additionally, lower surface 18 preferably includes a forward bevel 30, and a rearward bevel 32. Each of bevels 30 and 32 defines an oblique, sloping surface that reduces the surface area of lower surface 18, for reduced frictional drag as pad member 12 is moved along a flat, substantially planar surface, and also to provide a planing effect when pad member 12 is moved over a yieldable surface, such as sand, gravel, loose earth, and the like. In any event, effective use of the invention requires various degrees of stabilizing frictional resistance between pad member 12 and the surface on which the pad member rests, so that the leg muscles are assured of a dependable stability while undergoing a muscle conditioning effect.

As best seen in FIG. 3, pad member 12 includes an inner, rectangular slot 34 that extends completely through pad member 12 between upper surface 16 and lower surface 18. Slot 34 is preferably of rectangular cross section, and is defined by two pairs of opposed surfaces, one pair of which is preferably parallel with respective ones of upper and lower surfaces 16, 18. Slot 34 has a longitudinal axis that extends in a direction parallel with the longitudinal axes of each of grooves 26 and of ridges 28.

Leg muscle stretching and conditioning device 10 also includes a flexible, elongated belt member 36 that has a generally rectangular cross section as shown in FIG. 3. Belt member 36 passes through slot 34 in pad member 12 to permit pad member 12 to slide along belt member 36, as will hereinafter be explained in greater detail. Preferably, belt member 36 is made from a flexible, substantially inextensible material, such as polyvinyl chloride (PVC) plastic, or the like, and has smooth surfaces to enable pad member 12 to slide along belt member 36. The cross-sectional area and shape of belt member 36 is such as to permit engagement of the respective surfaces of belt 36 and of slot 34 to provide some degree of frictional resistance between belt 36 and pad member 12 during relative movement of those elements. In that regard, and for illustrative purposes only, a belt member having a thickness of 5/32 inches and a width of 1 9/16 inches has been found to work well with a pad member having a slot height of 3/16 inches and a slot width of 1 11/16 inches.

Figure 4:
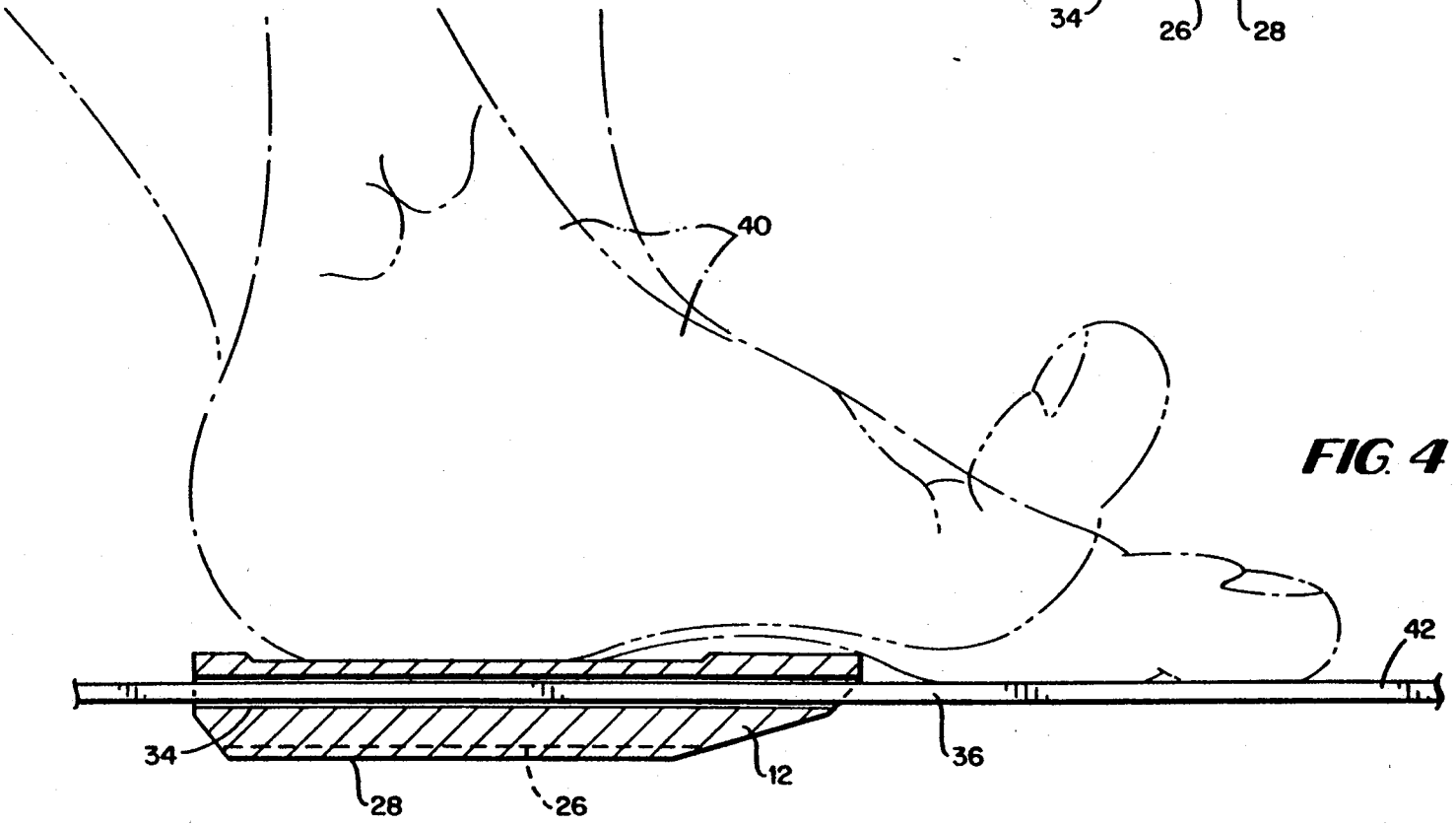
FIG. 4 is a longitudinal cross sectional view of the pad member of FIG. 1, showing the belt member extending through the pad member, and showing the foot of a user in two distinct positions on the pad member and on the belt member.

FIG. 4 shows pad member 12 and belt member 36 in operative position relative to a human foot 40 to illustrate the size relationship between pad member 12 and the heel and arch of foot 40. As is apparent from FIG. 4, pad member 12 is so sized that the toes and ball of the foot extend beyond the periphery of the pad member to permit those parts of the foot to contact the upwardly-facing surface 42 of belt 36. The size of pad member 12 permits foot 40 to assume any position relative to belt member 36, with an equal option of a stationary position or any increment of relative movement desired.

Figure 5:
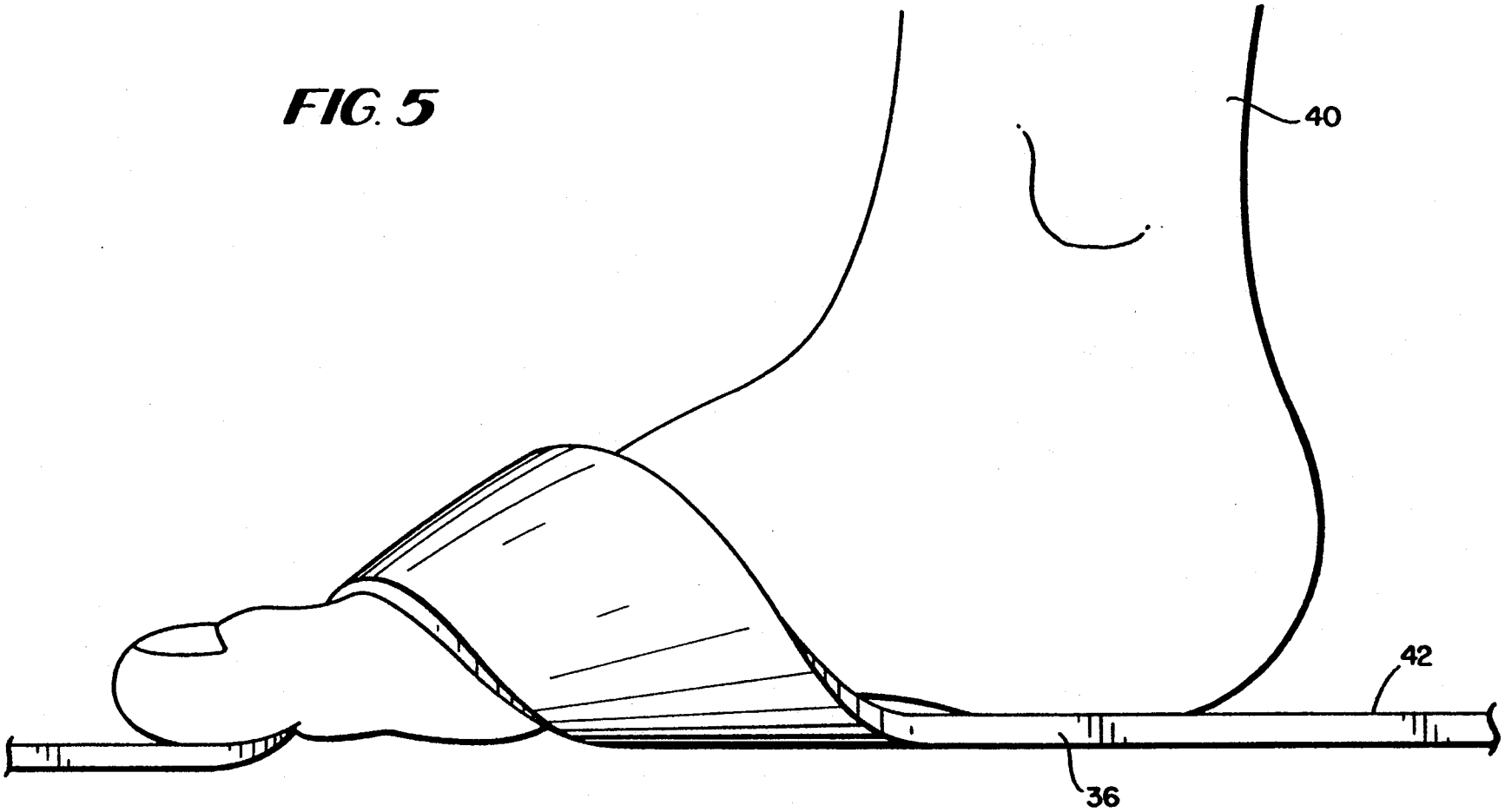
FIG. 5 is a fragmentary elevational view showing the foot of a user applied to fix the belt in a desired position.

FIG. 5 illustrates one method of securing belt member 36 in a fixed, stationary position relative to the surface over which the pad member is intended to be shifted. As shown, belt member 36 extends forwardly from the toes, and a portion of the belt member is passed around the outer side of foot 40, over the instep, around the inner side of the foot, and under the arch to pass rearwardly of and under the heel, so that the body's weight acts downwardly on the belt member to firmly urge the belt member against the surface upon which the device and the user are positioned. It will be appreciated that other methods of fixing the belt in position on the surface can also be employed, and the technique shown in FIG. 5 is merely illustrative.

In use, movement of the pad member along the belt member is initiated by simply shifting the body's weight to the heel of the foot that is resting on the pad member, thereby lifting the toes and ball of that foot off the belt member, while simultaneously extending the leg to produce a sliding movement along the belt member. Leg movement can be stopped at any time by again pressing the toes and ball of the foot back down on the surface of the belt member. FIG. 4 illustrates in dashed lines the initiation of movement by having shifted the body's weight to the heel, thereby lifting the toes and the ball of the foot off the surface of the belt member. The leg is then moved outwardly, to the side, producing a sliding movement of the pad member along the belt member.

Figure 6:
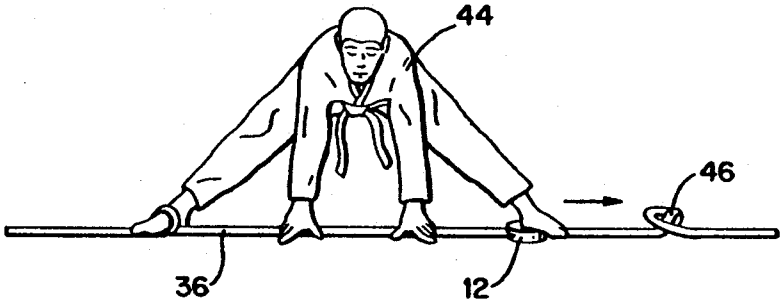
FIG. 6 is an elevational view showing a device in accordance with the present invention in use by a user preparatory to execution by the user of a so-called "chinese split" maneuver.

FIG. 6 illustrates the initial positions of a user 44 and of the parts of the device in accordance with the present invention at the commencement of the classical "Chinese Split" maneuver. Belt member 36 is extended and a knot 46 is provided in the belt member to define a stop. Belt member 36 is looped around and under the right foot of user 44 to define a stationary point, and the user's left foot is placed on pad member 12. As the left leg is thrust laterally outwardly away from the right leg, which remains fixed to the belt member, the left heel and pad member move in the direction of knot 46 along the belt member.

Figure 7:
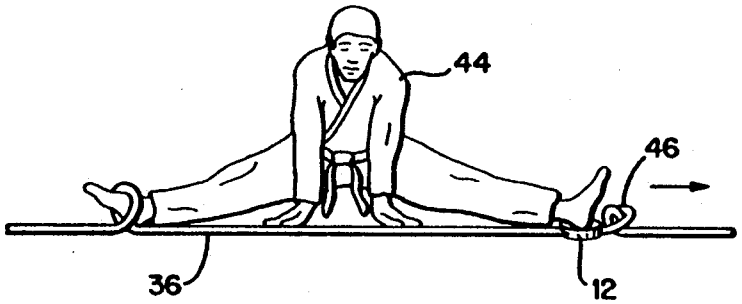
FIG. 7 is an elevational view similar to FIG. 6 showing the relative positions of the user and of the device upon substantial completion of the "chinese split" maneuver.

FIG. 7 illustrates an almost completed "Chinese Split," stopping just short of a full outward extension of the legs. The maximum movement distance between the user's feet has been determined by the spacing between the fixed position of the user's right foot and knot 46. Upon completion of the "Chinese split," the user's legs are fully extended outwardly and are in full contact with the flat surface or floor on which that conditioning technique is completed.

Figure 8:
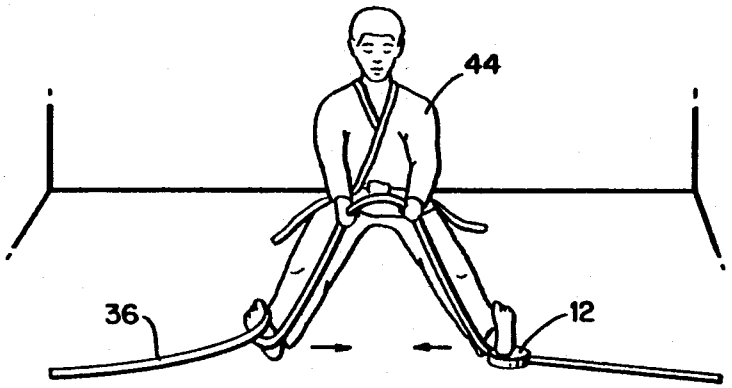
FIG. 8 is an elevational view showing a user and a device in accordance with the present invention as the user is executing a leg-together recovery from a completed "chinese split."

FIG. 8 illustrates how a return movement from the fully extended "chinese split" position can be effected. User 44, while seated, grasps and pulls on belt member 36 with both hands to draw the legs together in order to compensate for the absence of leg muscle control while the legs are in the fully outwardly extended position. The legs are then simultaneously pulled laterally toward each other in an arcing sweep to a point at which normal leg muscle control returns, whereupon continued leg movement until the legs are together is effected by the leg muscles by the right leg pulling toward the left at the loop around the right foot, and the left foot pulling the pad member along the floor surface and toward the right foot along belt member 36.

Figure 9:
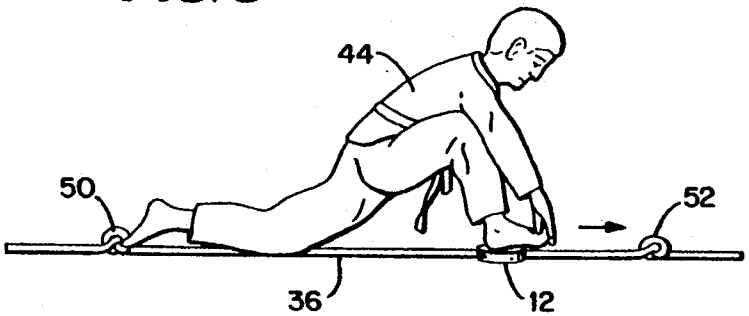
FIG. 9 is an elevational view showing a device in accordance with the present invention in use by a user preparatory to execution by the user of a so-called "dancer's split" maneuver.
Figure 10:
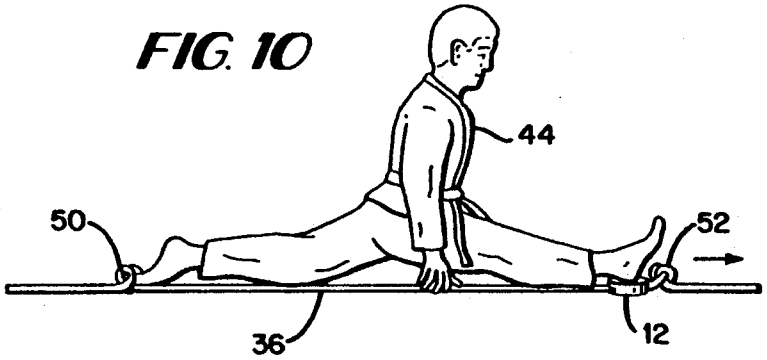
FIG. 10 is an elevational view similar to FIG. 9 showing the relative positions of the user and of the device upon substantial completion of the "dancer's split" maneuver.

FIGS. 9 and 10 illustrate the initial and final positions, respectively, of a user and of a conditioning device in accordance with the present invention, during execution of the classical "Dancer's Split." The toes of the stationary foot are engaged with a first knot 50 tied in the belt to define the stationary point. Similarly, a second knot 52 is tied in belt member 36 at a predetermined distance from first knot 50 to define the maximum excursion of the user's legs. As the split proceeds, the user's left leg and pad member 12 move along belt member 36, until knot 52 is contacted. Upon completion of the maneuver, the right leg is returned to its initial position. The maneuver can be repeated with the extension of the right foot by interchanging the positions of the feet relative to the first knot and the pad member.

Figure 11:
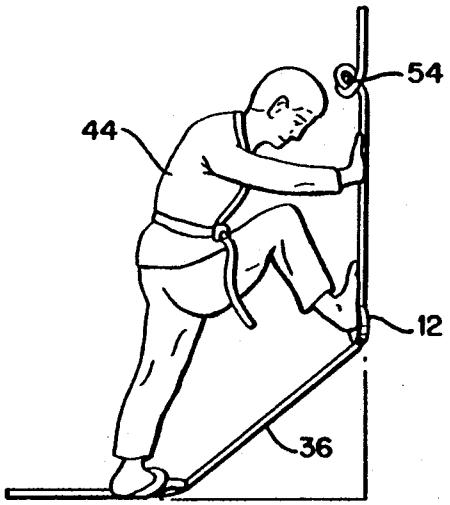
FIG. 11 is an elevational view showing a device in accordance with the present invention in use by a user preparatory to execution by the user of a so-called "front kick stretch" maneuver.
Figure 12:
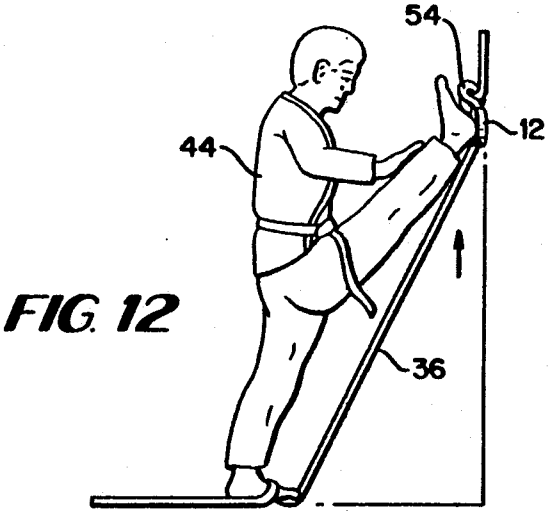
FIG. 12 is an elevational view similar to FIG. 11 showing the relative positions of the user and of the device upon substantial completion of the "front kick stretch" maneuver.

FIGS. 11 and 12 illustrate two positions of a user and of a conditioning device in accordance with the present invention during execution of the so-called "front kick stretch" maneuver, using the leg muscle conditioning device braced partially against a vertical wall and partially against a floor surface. The amount of stretch and the vertical distance can be controlled by the spacing from the stationary point, where the belt member is wrapped around one foot at the floor, and the knot 54, which defines the maximum vertical movement of pad member 12 along belt member 36.

Figure 14:
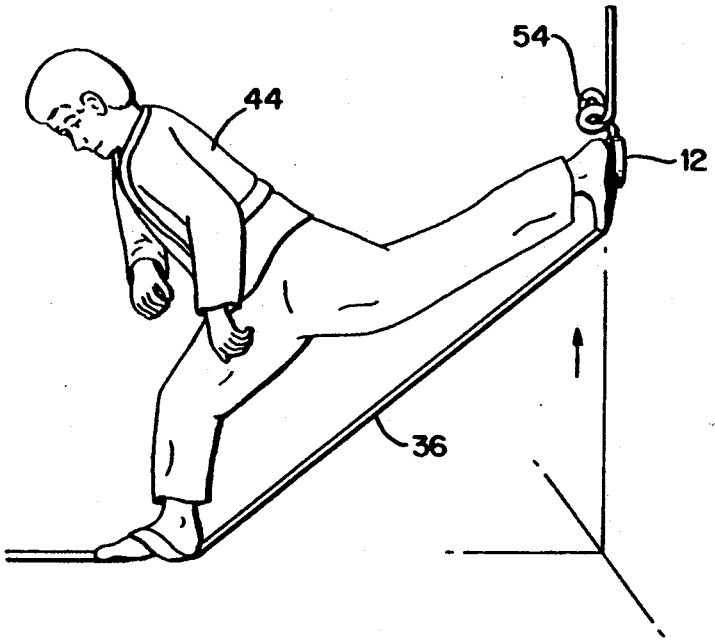
FIG. 14 is an elevational view similar to FIG. 13 showing the relative positions of the user and of the device upon completion of the back-vertical-kick stretch maneuver.
Figure 13:
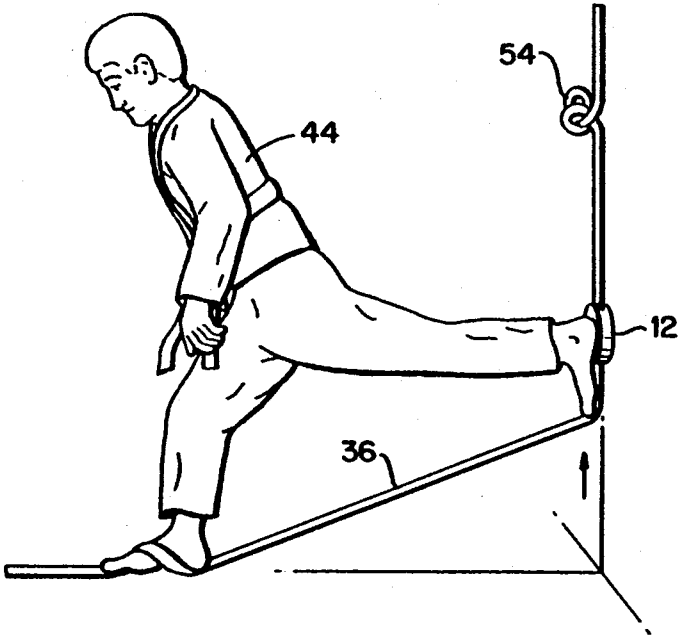
FIG. 13 is an elevational view showing a device in accordance with the present invention in use by a user at the commencement of a back-vertical-kick stretch.

FIGS. 13 and 14 illustrate the employment of the leg muscle conditioning device in performing the so-called "back-vertical-kick" stretch, as initiated with the heel of the left leg placed on pad member 12, which is against a wall. Belt 36 is shown against the wall for illustrative purposes, and it will be appreciated that the belt will initially drape over the left foot and will assume the position shown as the maneuver proceeds. The right foot is on the ground with belt 36 wrapped around it. The left leg and pad member are moved upwardly along the wall until the pad member contacts knot 54. Consequently, with the device in accordance with the present invention the user is able to reach the maximum muscle stretch in a slow and controlled manner that can be held and increased as the user's muscles expand in length. The disclosed technique stresses anterior hip flexion combined with a pronounced quadriceps stretch.

Figure 15:
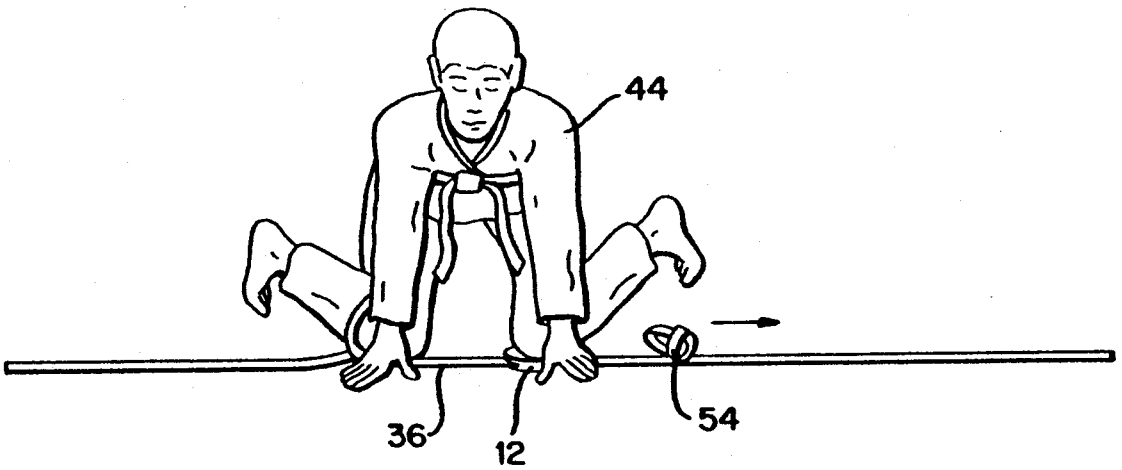
FIG. 15 is an elevational view showing a device in accordance with the present invention in use by a user at the commencement of a groin-hip-flexing stretch maneuver.
Figure 16:
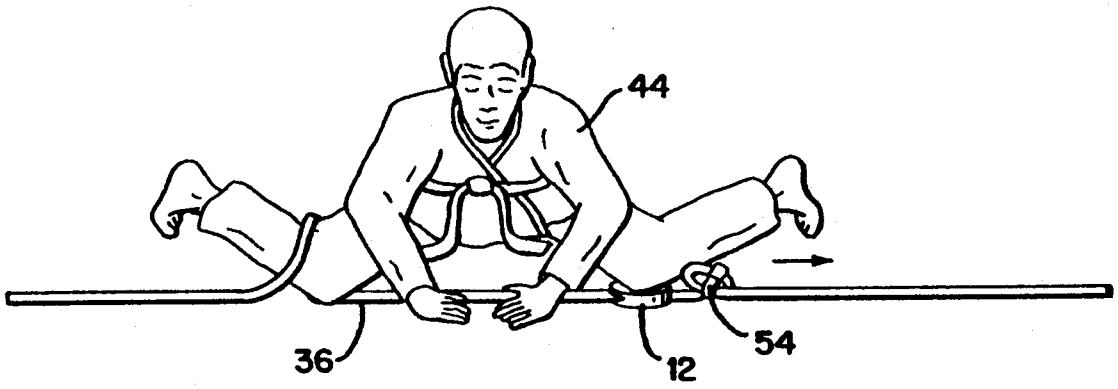
FIG. 16 is an elevational view similar to FIG. 15 showing the relative positions of the user and of the device upon completion of the groin-hip-flexing stretch maneuver.

FIGS. 15 and 16 illustrate the groin-hip-flexing stretch, which is an essential component of the double aerial stretch kick. The disclosed technique requires a slow motion that drives the lower abdomen area directly downwardly, spreading the frontal pelvic area at the hip and groin areas. The use of the present invention permits a fluid motion that can be readily executed, to stretch strong muscles that offer considerable resistance to stretching.

In the course of performing conditioning exercises under the guidance of a teacher or instructor, the teacher is merely an external aid to learning (as a provider of incentive, reason, and a prod to learn). In its proper usage as providing both physical and mental stimulation, the leg muscle conditioning device in accordance with the present invention supplies the fostering counterpart of a multitude of learning situations, while also, because of the simplicity of the device, generating back to the individual the greater result of participation as the beneficiary and responsible partner in the experience.

Far too many teachers in the fields of medicine, entertainment, and exercise (by way of design) usurp the actualization of experiential learning by affirmatively doing something to a student, rather than by leading the student to do for himself. Teachers should offer the student a minimal amount of quality guidance and require of the student the exercise of the attributes of discovery, curiosity, and awareness, leading to a recognition by the student of the advantages of using one's own mind and body as a source of self edification, while also maximizing the student's involvement in the personal process of acquiring knowledge.

The present invention and its use are premised upon the concepts of "simplicity and adaptability," allowing the human body to find natural equilibria states for safeguarding against injury by allowing freedom of movement, rather than by confinement of movement. The inherent freedom of movement incident to use of the present invention eliminates the danger of subjecting the body to a rigid constraint that potentially could cause an injury. It accommodates the natural tendency and need for the joints, ligaments, and muscles to make adjustments to sudden new stresses, because the stresses are applied in a slow, controlled manner, thereby minimizing the exposure of the body to injuries.

In addition to the beneficial physical and mental consequences achievable from use of the present invention by those having advanced skill, the design of the device in accordance with the present invention is intended to functionally accommodate the needs of rank beginners. In general, for beginners in the field of physical movements the fewer the variables the better. Therefore, the less chaotic a movement can be made the greater the ease with which the beginner may grasp the fundamentals of the movement and make the necessary physical adjustments. The same is true with stretching techniques, because a beginner might possibly suffer injury from attempting a body movement composed of too many individual movements for the beginner to keep track of, and that could lead to a posture involving unusual, and unwarranted physical stresses leading to possible body tissue damage.

The present invention permits a controlled stretch to be initiated from a single direction, rather than from multiple directions as could conceivably occur from having both supporting limbs on separate movable platforms that can quickly scoot out from a center in opposite radial directions without warning. That course of events could easily confuse the beginner's focus, it could destroy the needed attention to performance, and it could lead to any number of possible injuries, including a fall from any angle.

Both the pad member and the belt member of the device in accordance with the present invention are conceptually designed based upon traditional martial arts philosophy and apparatus. The heel portion of the pad member can include the "Yin" and "Yang" symbols on its upper surface. The belt member of the device is designed based upon the traditional martial arts belt epitomizing the art itself in conceptual simplicity and adaptability. Together the parts of the device bring performance and philosophy full circle to accommodate both the beginner and the student of advanced skill.

In addition to the front-vertical-kick stretch and the back-vertical-kick stretch, other specific martial arts leg stretches can be enhanced and controlled through the use of the present device. For example, the initiated double leg aerial stretch and the groin-hip flexing stretch initiated from a kneeling position, as will be appreciated by those versed in the martial arts.

Of considerable importance in the use of the present invention for practicing the many hyper-extended martial art leg stretches is the return of the legs to the starting position. As part of the intended beneficial use of the present invention is the further advantage that proper use of the invention assists the individual's legs to recover from an extreme stretch, as in the case of the Chinese split, because the device as designed incorporates features to permit such recovery.

At the ultimate extension of the Chinese split the legs are pointing in directly opposite directions, and are in line with the shoulders. After many months of training, years for some, the practitioner might have the physical conditioning and strength to move his or her legs voluntarily, but for the beginner it would be the rare exception indeed to be able to move the legs at all without assistance. In this instance, the practitioner needs only to grasp the belt at a natural shoulder width distance and to slowly raise and pull the hands together, causing the hyper-extended legs to be brought within a range of motion where the individual may exert his or her own physical hip and leg strength to fully bring the legs back to the straight-out-in-front recovery position.

In the preceding discussion, it has been assumed that the device will be used in the confines of a gymnasium with a hard floor. Within this limited environment the device has been designed to expand those finite boundaries, assisting the practitioner to greater heights of proficiency.

Many martial arts studios, dance studios, as well as fitness clubs now have wall-to-wall carpeting that can cause "rug burn," and can impose resistance to movement of a caster or a ball-bearing-guided apparatus. A pitted asphalt surface, a gravel surface, or an earthen surface would pose an even greater impediment to the travel of a caster or of ball-bearing-type conveyances that rely on a smooth, hard surface, especially when such devices are burdened with any weight. Those obstructive surface conditions are of no consequence to the device in accordance with the present invention, because of its beveled forward and rearward edges on the pad member, which because of its configuration easily slides over all forms of surface conditions.

A purpose of martial arts study is to build resolve through training in every conceivable environment available in the natural world. That philosophy is thought to best provide a curriculum that prepares the student for approaching the infinite variables found in life. One readily available altered environment is achieved by being partially or completely submerged in water for the practice of martial art katas and stretches specific to the art. In this changed environment the device in accordance with the present invention easily adapts to such new demands.

Mastering the difficult martial arts stretches can be a even greater strain underwater. Depending upon the condition of the underwater surface, a practitioner could either be hampered by a soft, sandy bottom or could suffer possible injury from sharp objects embedded in the underwater floor, unless assisted and protected by the ability of the device to be readily moved over any form of surface while also being submerged in water.

The versatility of the device, in workmanship and in design, extends beyond the normal training system, making it adaptable to and virtually indestructible in all weather conditions and environments, in snow covered conditions, from rocky ridges to desert sands to grassy fields, and the myriad forms of surfaces hidden at the bottom of a body of water.

The pad member is much more than just a transporting entity, as the belt member of the device is more than merely a connecting medium. The parts, together, become a doorway to infinite training possibilities, seen and unseen, touched and untouched, perceivable and yet to be envisioned. Simplicity and adaptability, from conceptual beginning to tangible reality, remain the underlying criteria for the design and use of the invention.

Although particular embodiments of the present invention have been illustrated and described, it would be apparent to those skilled in the art that various changes and modifications can be made without departing from the spirit of the present invention. It is therefore intended to encompass within the appended claims all such changes and modifications that fall within the scope of the present invention.

What is claimed is:

1. A leg muscle stretching and conditioning device adapted for convenient portability and for use on a wide variety of surfaces, said device comprising:

a. a pad member having an upper surface adapted for receiving and supporting a first foot of a user, said upper surface having a recess adapted to receive a heel or knee of a user, a lower surface spaced from the upper surface for sliding engagement with a supporting surface for providing stretching to the user, and a slot extending through the pad member between the upper and lower surfaces, the slot having a longitudinal axis; and b. A flexible belt member having first and second free ends with at least one free end adapted to wrap around a second foot of the user and having a predetermined length, the belt member having a uniform transverse cross section conforming substantially in size and shape with the slot to permit the belt to be slidably received in the slot for sliding movement of the pad member along a support surface and along and relative to the belt while the lower surface of the pad member and the belt are in contact with the supporting surface.

2. A leg muscle stretching and conditioning device in accordance with claim 1 wherein the lower surface of the pad member includes a plurality of alternating grooves and ridges.

3. A leg muscle stretching and conditioning device in accordance with claim 2 wherein the alternating grooves and ridges are parallel with the longitudinal axis of the slot.

4. A leg muscle stretching and conditioning device in accordance with claim 2 wherein the alternating grooves and ridges are of trapezoidal cross section.

5. A leg muscle stretching and conditioning device in accordance with claim 2 wherein the alternating grooves and ridges have respective leading and trailing edges that define respective forward and rearward arcs on the lower surface of the pad member.

6. A leg muscle stretching and conditioning device in accordance with claim 2 wherein the slot is of rectangular cross section.

7. A leg muscle stretching and conditioning device in accordance with claim 6 wherein the belt member is of rectangular cross section.

8. A leg muscle stretching and conditioning device in accordance with claim 1 wherein the belt member is made from a plastic material.

9. A leg muscle stretching and conditioning device in accordance with claim 8 wherein the belt member is made from polyvinyl chloride.

10. A leg muscle stretching and conditioning device adapted for convenient portability and for use on a wide variety of surfaces, said device comprising:

a. a pad member having an upper surface adapted for receiving and supporting a first foot of a user, a lower surface spaced from the upper surface for sliding engagement with a supporting surface, said lower surface of the pad member including a plurality of alternating grooves and ridges, said alternating grooves and ridges having respective leading and trailing edges that define respective forward and rearward arcs on said lower surface of said pad member, and a slot extending through the pad member between the upper and lower surfaces, the slot having a longitudinal axis; and b. a flexible belt member having first and second free ends with at least one free end adapted to wrap around a second foot of the user and having a predetermined length, the belt member having a uniform transverse cross section conforming substantially in size and shape with the slot to permit the belt to be slidably received in the slot for sliding movement of the pad member along a support surface and along and relative to the belt while the lower surface of the pad member and the belt are in contact with the supporting surface.

* * * * *